US009190721B2

(12) United States Patent
Yukimoto et al.

(10) Patent No.: US 9,190,721 B2
(45) Date of Patent: Nov. 17, 2015

(54) ANTENNA DEVICE

(71) Applicant: MITSUBISHI MATERIALS CORPORATION, Tokyo (JP)

(72) Inventors: Shinsuke Yukimoto, Saitama (JP); Ryo Saito, Saitama (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 188 days.

(21) Appl. No.: 13/899,165

(22) Filed: May 21, 2013

(65) Prior Publication Data

US 2014/0015721 A1 Jan. 16, 2014

Related U.S. Application Data

(63) Continuation of application No. PCT/JP2011/006436, filed on Nov. 18, 2011.

(30) Foreign Application Priority Data

Nov. 24, 2010 (JP) ..... 2010-261786

(51) Int. Cl.

| | |
|---|---|
| ***H01Q 9/00*** | (2006.01) |
| ***H01Q 1/38*** | (2006.01) |
| ***H01Q 9/42*** | (2006.01) |
| ***H01Q 11/08*** | (2006.01) |
| ***H01Q 5/10*** | (2015.01) |

(52) U.S. Cl.

CPC . *H01Q 1/38* (2013.01); *H01Q 5/10* (2015.01); *H01Q 9/42* (2013.01); *H01Q 11/08* (2013.01)

(58) Field of Classification Search

CPC ..... H01Q 9/00

See application file for complete search history.

(56) References Cited

U.S. PATENT DOCUMENTS

| | | | | |
|---|---|---|---|---|
| 7,148,851 | B2 * | 12/2006 | Takaki et al. | 343/702 |
| 8,212,731 | B2 * | 7/2012 | Bungo et al. | 343/749 |
| 8,743,010 | B2 * | 6/2014 | Yanagi et al. | 343/845 |
| 8,952,852 | B2 * | 2/2015 | Badaruzzaman et al. | 343/702 |
| 2002/0126046 | A1 * | 9/2002 | Counselman et al. | 342/464 |
| 2004/0104850 | A1 * | 6/2004 | Otaka et al. | 343/700 MS |

FOREIGN PATENT DOCUMENTS

| | | | |
|---|---|---|---|
| CN | 1926720 | A | 3/2007 |
| CN | 201072804 | Y | 6/2008 |
| EP | 1703586 | A1 | 9/2006 |
| EP | 2629365 | A1 | 8/2013 |
| JP | 2006196994 | A | 7/2006 |
| JP | 2009111999 | A | 5/2009 |
| JP | 2009278376 | A | 11/2009 |
| JP | 2010087752 | A | 4/2010 |
| WO | WO-2005/064743 | A1 | 7/2005 |

OTHER PUBLICATIONS

Extended European Search Report dated Dec. 23, 2014 for European Patent Application No. 11843007.3.

Chinese Office Action dated May 9, 2014 issued for corresponding Chinese Patent Application No. 201180056476.1.

International Search Report Of PCT/JP2011/006436.

* cited by examiner

*Primary Examiner* — Huedung Mancuso

(74) *Attorney, Agent, or Firm* — Locke Lord LLP; Jeffrey D. Hsi

(57) ABSTRACT

Provided is an antenna device which is capable of flexibly adjusting multiple resonance frequencies. The antenna device is provided with a substrate main body (2), a ground pattern (GP), a first element (3), a second element (4) and a third element (5).

8 Claims, 6 Drawing Sheets

(a)

(b)

ANTENNA DEVICE

CROSS REFERENCE TO RELATED APPLICATIONS

This application claims priority to PCT International Application No. PCT/JP2011/006436, filed Nov. 18, 2011, which claims the benefit of Japanese Patent Application No. 2010-261786 filed Nov. 24, 2010, the entire contents of the aforementioned applications are hereby incorporated herein by reference.

BACKGROUND OF THE INVENTION

1. Field of the Invention

The present invention relates to an antenna device which is capable of supporting multiple resonance frequencies.

2. Description of the Related Art

Conventionally, in order to multiple-resonate the resonance frequency of an antenna provided in communication equipment, there has been proposed an antenna including a radiation electrode and a dielectric block or an antenna device using a switch and a controlled voltage source.

For example, as a conventional technique using a dielectric block, Patent Document 1 discloses a high-efficiency composite antenna which is obtained by forming a radiation electrode into a molded resin article and then integrating the molded resin article and a dielectric block with an adhesive.

Also, as a conventional technique using a switch and a controlled voltage source, Patent Document 2 discloses an antenna device including a first radiation electrode, a second radiation electrode, and a switch which is interposed between the middle part of the first radiation electrode and the base end part of the second radiation electrode and electrically connects or disconnects the second radiation electrode to/from the first radiation electrode.

PRIOR ART DOCUMENTS

Patent Documents

Patent Document 1: Japanese Laid-Open Patent Publication No. 2010-81000

Patent Document 2: Japanese Laid-Open Patent Publication No. 2010-166287

SUMMARY OF THE INVENTION

Problems to be Solved by the Invention

However, the following problems still remain in the conventional techniques described above.

Specifically, in the technique using a dielectric block as disclosed in Patent Document 1, a dielectric block for exciting a radiation electrode is used so that the dielectric block, the radiation electrode pattern, and the like need to be designed for each equipment, resulting in a disadvantage in that the antenna performance may be deteriorated depending on the design conditions or the unstable factors may increase. Also, since a radiation electrode is formed on the surface of a molded resin article, a radiation electrode pattern needs to be designed on the molded resin article. Consequently, antenna design and die design are required depending on communication equipment for implementation or its application, resulting in a considerable increase in cost. Furthermore, a dielectric block and a molded resin article are integrated with an adhesive, resulting in deterioration of the antenna performance or an undesirable increase in the unstable factors depending on adhesion conditions (thickness of adhesive, adhesive area, and the like) other than the Q value of adhesive.

In the case of an antenna device using a switch and a controlled voltage source as disclosed in Patent Document 2, the resonance frequency is switched by the switch so that the configuration of a controlled voltage source, a reactance circuit, and the like are required, resulting in a complication of the antenna configuration for each equipment, no degree of freedom in design, and a difficulty in readily adjustment of the antenna.

The present invention has been made in view of the aforementioned circumstances, and an object of the present invention is to provide an antenna device which is capable of flexibly adjusting multiple resonance frequencies and is also capable of achieving a size reduction and thinning as well as readily ensuring the antenna performance at low cost depending on its application for each equipment.

Means for Solving the Problems

The present invention adopts the following structure in order to solve the aforementioned problems. Specifically, the antenna device of the present invention is characterized in that the antenna device includes an insulating substrate main body; and a ground pattern, a first element, a second element, and a third element each of which is patterned with metal foil on the substrate main body, wherein the ground pattern extends in one direction while being connectable to a ground at the base end side, the first element extends such that a feed point is provided at the base end which is arranged near the base end side of the ground pattern, a first passive element is connected at an intermediate portion which is arranged along the ground pattern intermediate portion, and a first antenna element of a dielectric antenna is provided closer to the tip end side than the first passive element, the second element extends such that the base end thereof is connected to the base end side of the ground pattern and the tip end thereof is connected to the intermediate portion provided closer to the base end side than the first passive element of the first element, the third element extends such that the base end thereof is connected closer to the base end side than the first passive element of the first element and a second passive element is connected at an intermediate point, the first element extends with a gap provided between the first element and each of the second element, the third element, and the ground pattern so as to be able to generate a stray capacitance between the first element and the second element, a stray capacitance between the first element and the third element, and a stray capacitance between the first element and the ground pattern, and the ground pattern extends such that the tip end thereof is provided within a range from a position facing the connecting part between the first element and the second element to a position facing the first passive element.

In the antenna device, since the first element extends with a gap provided between the first element and each of the second element, the third element, and the ground pattern such that a stray capacitance can be generated between the first element and the second element, between the first element and the third element, and between the first element and the ground pattern, the antenna device can be provided with a multiple resonance characteristic by effectively utilizing a stray capacitance between the first antenna element serving as a loading element which is not self-resonant to a desired resonance frequency and each element. By selecting the first antenna element, the first passive element, and the second passive element, an antenna device which is capable of flexibly adjusting resonance frequencies and achieving a double resonance characteristic depending on application, equipment, and design conditions can be obtained. Note that a bandwidth can be adjusted by setting the lengths and widths of the elements and the stray capacitances.

Design can be made within the plane of the substrate main body so that thinning of the substrate main body can be achieved as compared with the case where a conventional dielectric block, molded resin article, or the like is used. In addition, a size reduction and enhanced performance can be achieved by selecting a first antenna element serving as a dielectric antenna. Furthermore, no additional cost is incurred due to change in die and design, resulting in realization of a low cost product.

Furthermore, since the ground pattern extends such that the tip end thereof is provided within a range from a position facing the connecting part between the first element and the second element to a position facing the first passive element, a stray capacitance is generated between the ground pattern and the first element and the ground pattern functions as a high-frequency current control unit that generates a high-frequency current flow in a direction along the ground pattern. Consequently, even when a wide ground plane is not formed on the surface of the substrate main body, the influence of the routing of a coaxial cable or the like connected to a feed point on antenna characteristics can be reduced. Thus, the size (corresponds to an antenna occupied area) of the substrate main body can be reduced because a wide ground plane becomes unnecessary and the high degree of freedom in wiring and substrate installation can be obtained because the influence of the routing of a coaxial cable or the like connected to a feed point on antenna characteristics is reduced.

The reason why the ground pattern extends such that the tip end thereof is provided within a range from a position facing the connecting part between the first element and the second element to a position facing the first passive element is that, if the ground pattern is extended less than a position facing the connecting part between the first element and the second element, a sufficient stray capacitance required for reducing the influence of a coaxial cable or the like cannot be ensured between the ground pattern and the first element, whereas if the ground pattern is extended greater than a position facing the first passive element, a high-frequency current flow in a direction along the ground pattern adversely affects the tip end of the first element which is an adjacent high impedance portion, resulting in degradation in antenna performance.

Also, the antenna device of the present invention is characterized in that the first element includes a first extension portion extending from the feed point provided on the ground pattern side in a direction away from the ground pattern, a second extension portion extending from the tip end of the first extension portion to the connecting part with the second element which extends in a direction along the ground pattern, a third extension portion extending from the tip end of the second extension portion to a direction along the ground pattern, a fourth extension portion extending from the tip end of the third extension portion in a direction away from the ground pattern, a fifth extension portion extending from the tip end of the first antenna element toward the ground pattern via the first passive element and the first antenna element which are juxtaposed in a direction along the ground pattern from the fourth extension portion, and a sixth extension portion extending from the tip end of the fifth extension portion toward the first extension portion along the ground pattern, the second element includes a seventh extension portion extending in a direction away from the ground pattern, an eighth extension portion extending from the tip end of the seventh extension portion to a direction along the ground pattern, and a ninth extension portion extending from the tip end of the eighth extension portion to the connecting part with the first element in a direction away from the ground pattern, and the third element includes a tenth extension portion extending from the first extension portion in the same direction as the first extension portion and an eleventh extension portion extending from the tenth extension portion along the second extension portion.

Specifically, in the antenna device, since each of the first to the third elements includes the extension portions as described above, a stray capacitance between the sixth extension portion and the first antenna element, a stray capacitance between the sixth extension portion and the ground pattern, a stray capacitance between the eighth extension portion and the ground pattern, a stray capacitance between the eighth extension portion and the second extension portion, a stray capacitance between the fourth extension portion and the tip end of the eleventh extension portion, a stray capacitance between the third extension portion and the eleventh extension portion, and a stray capacitance between the second extension portion and the eleventh extension portion can be generated, resulting in obtaining a high degree of freedom in adjustment of resonance frequencies.

Also, the antenna device of the present invention is characterized in that the first element includes a wide portion which is formed facing the tip end of the third element such that a stray capacitance can be generated therebetween.

Specifically, in the antenna device, since the first element includes a wide portion which is formed facing the tip end of the third element such that a stray capacitance can be generated therebetween, a stray capacitance between the tip end of the third element and the wide portion can be readily set. In addition, the effective area of the entire antenna increases, resulting in achieving broadband and high gain features.

Also, the antenna device of the present invention is characterized in that the second antenna element of the dielectric antenna is provided at the tip end of the third element.

Specifically, in the antenna device, since the second antenna element of the dielectric antenna is provided at the tip end of the third element, the length of the tip end of the third element can be shortened by the second antenna element so that the entire antenna occupied area can be further reduced.

Also, when the wide portion is employed, the antenna device is readily affected by a stray capacitance between the tip end of the third element and the wide portion, resulting in achieving broadband and high gain features.

Effects of the Invention

According to the present invention, the following effects may be provided.

Specifically, according to the antenna device of the present invention, the first element extends with a gap provided between the first element and each of the second element, the third element, and the ground pattern such that a stray capacitance can be generated between the first element and the second element, between the first element and the third element, and between the first element and the ground pattern. Thus, an antenna device which is capable of flexibly adjusting resonance frequencies and achieving a double resonance characteristic depending on design conditions can be obtained. In addition, a size reduction and enhanced performance can also be achieved. Furthermore, since the ground pattern extends such that the tip end thereof is provided within a range from a position facing the connecting part between the first element and the second element to a position facing the first passive element, the ground pattern functions as a high-frequency current control unit. Consequently, even when a wide ground plane is not formed on the surface of the substrate main body, the influence of the routing of a coaxial cable or the like on antenna characteristics can be reduced.

Thus, the antenna device of the present invention can be readily provided with a multiple resonance characteristic corresponding to a wide variety of applications or a wide variety of equipment, resulting in a reduction in space requirements and an improvement in the degree of freedom in wiring and installation.

BEST MODES FOR CARRYING OUT THE INVENTION

Hereinafter, a description will be given of an antenna device according to one embodiment of the present invention with reference to FIGS. 1 to 4.

Figure 1:
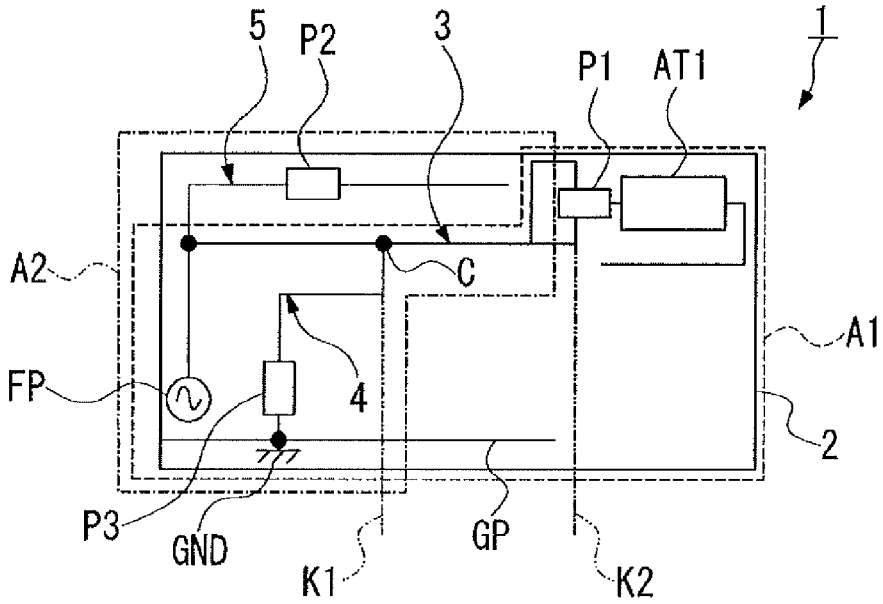
FIG. 1 is a plan view illustrating an antenna device according to one embodiment of the present invention.

As shown in FIG. 1, an antenna device 1 of the present embodiment includes an insulating substrate main body 2, a ground pattern (GP), a first element 3, a second element 4, and a third element 5 each of which is in the form of metal foil such as copper foil and has been patterned on the surface of the substrate main body 2.

The substrate main body 2 is a typical printed circuit board. In the present embodiment, the main body of a printed circuit board consisting of a rectangular glass epoxy resin or the like is employed as the substrate main body 2.

The ground pattern (GP) extends in one direction of the long side direction of the substrate main body 2 such that the ground pattern (GP) is connectable to the ground (GND) at the base end and is formed on one long side of the substrate main body 2.

The first element 3 extends such that a feed point (FP) is provided at the base end which is arranged near the base end side of the ground pattern (GP), a first passive element (P1) is connected at an intermediate portion which is arranged along the ground pattern (GP), and a first antenna element (AT1) of a dielectric antenna is provided closer to the tip end side than the first passive element (P1).

Note that the feed point (FP) is connected to a high-frequency circuit (not shown) via a power supply unit such as a coaxial cable or the like. Examples of the power supply unit employable include various structures such as a connector such as a coaxial cable, a receptacle, or the like, a connection structure having a contact formed in a leaf spring shape, a connection structure having a contact formed in a pinprobe shape or pin shape, a connection structure using a soldering land, and the like.

For example, when a coaxial cable is employed as a power supply unit, the ground wire of the coaxial cable is connected at the base end of the ground pattern (GP) and the core wire of the coaxial cable is connected to the feed point (FP).

The second element 4 extends such that the base end thereof is connected to the base end side of the ground pattern (GP) via the third passive element (P3) and the tip end thereof is connected to the intermediate portion closer to the base end side than the first passive element (P1) of the first element 3. Specifically, the second element 4 is provided between the first element 3 and the ground pattern (GP).

The third element 5 extends such that the base end thereof is connected closer to the base end side than the first passive element (P1) of the first element 3 and the second passive element (P2) is connected at an intermediate point.

Figure 3:
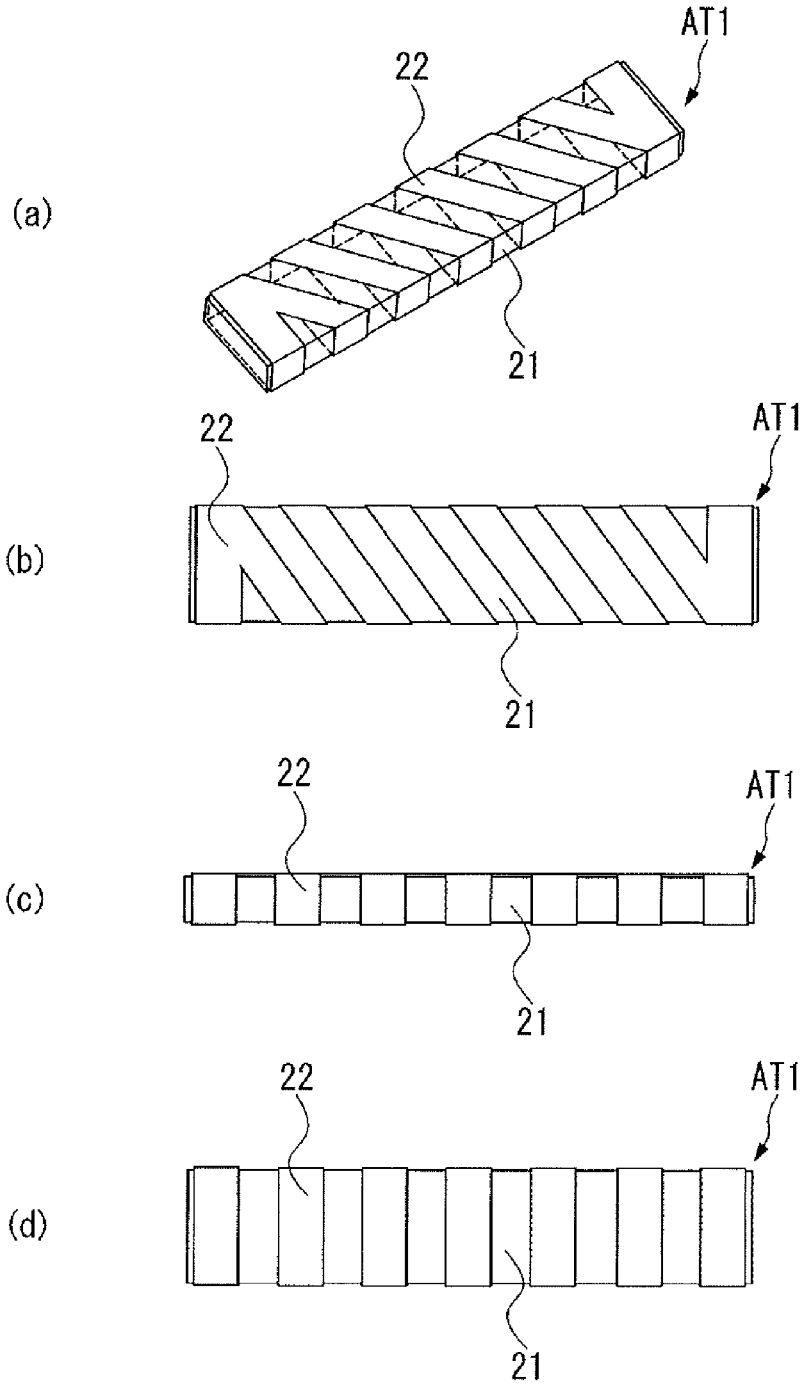
FIG. 3*a* is a perspective view illustrating a first antenna element according to the present embodiment.
FIG. 3*b* is a plan view illustrating a first antenna element according to the present embodiment.
FIG. 3*c* is a front view illustrating a first antenna element according to the present embodiment.
FIG. 3*d* is a bottom view illustrating a first antenna element according to the present embodiment.

The first antenna element (AT1) is a loading element which is not self-resonant to a desired resonance frequency and is, for example as shown in FIG. 3, a chip antenna in which a conductor pattern 22 such as Ag or the like is formed on the surface of a dielectric 21 such as ceramics or the like. For the first antenna element (AT1), elements having a different length, width, conductor pattern 22, or the like may be selected or the same elements may also be selected depending on the settings of resonance frequency or the like.

The first element 3 includes a first extension portion (E1) extending from a feed point (FP) provided on the ground pattern (GP) side in a direction away from the ground pattern (GP), a second extension portion (E2) extending from the tip end of the first extension portion (E1) to the connecting part (C) with the second element 4 which extends in a direction along the ground pattern (GP), a third extension portion (E3) extending from the tip end of the second extension portion (E2) to a direction along the ground pattern (GP), a fourth extension portion (E4) extending from the tip end of the third extension portion (E3) in a direction away from the ground pattern (GP), a fifth extension portion (E5) extending from the tip end of the first antenna element (AT1) toward the ground pattern (GP) via the first passive element (P1) and the first antenna element (AT1) which are juxtaposed in a direction along the ground pattern (GP) from the fourth extension portion (E4), and a sixth extension portion (E6) extending from the tip end of the fifth extension portion (E5) toward the first extension portion (E1) along the ground pattern (GP).

Specifically, the ground pattern (GP), the eighth extension portion (E8), the second extension portion (E2), the third extension portion (E3), the sixth extension portion (E6), and the eleventh extension portion (E11) extend in parallel to each other. Also, the first extension portion (E1), the fourth extension portion (E4), the fifth extension portion (E5), the seventh extension portion (E7), the ninth extension portion (E9), and the tenth extension portion (E10) extend in parallel to each other or extend in the same direction. Furthermore, the intermediate portion of the first element 3 is the second extension portion (E2) and the third extension portion (E3).

Note that the sixth extension portion (E6) is arranged away from the ground pattern (GP).

The first element 3 includes a wide portion which is formed facing the tip end of the third element 5 such that a stray capacitance can be generated therebetween. Specifically, the wide portion is the fourth extension portion (E4) which is in a rectangular shape of which the line width is wide as compared with that of other extension portions and one side thereof is arranged facing the tip end of the third element 5.

The second element 4 includes the seventh extension portion (E7) extending in a direction away from the ground pattern (GP) via the third passive element (P3), the eighth extension portion (E8) extending from the tip end of the seventh extension portion (E7) to a direction along the ground pattern (GP), and the ninth extension portion (E9) extending from the tip end of the eighth extension portion (E8) to the connecting part (C) with the first element 3 in a direction away from the ground pattern (GP).

The third element 5 includes the tenth extension portion (E10) extending from the first extension portion (E1) in the same direction as the first extension portion (E1), and the eleventh extension portion (E11) extending from the tenth extension portion (E10) along the second extension portion (E2) via the second passive element (P2).

The first element 3 extends with a gap provided between the first element 3 and each of the second element 4, the third element 5, and the ground pattern (GP) such that a stray capacitance can be generated between the first element 3 and the second element 4, between the first element 3 and the third element 5, and between the first element 3 and the ground pattern (GP).

Figure 2:
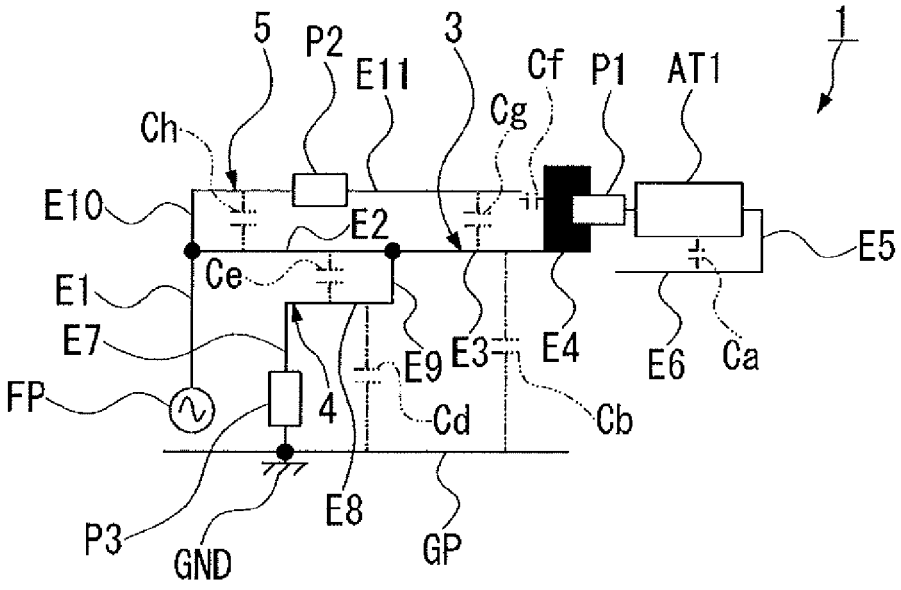
FIG. 2 is a wiring diagram illustrating a stray capacitance generated by an antenna device according to the present embodiment.

Specifically, as shown in FIG. 2, a stray capacitance (Ca) between the sixth extension portion (E6) and the first antenna element (AT1), a stray capacitance (Cb) between the third extension portion (E3) and the ground pattern (GP), a stray capacitance (Cd) between the eighth extension portion (E8) and the ground pattern (GP), a stray capacitance (Ce) between the eighth extension portion (E8) and the second extension portion (E2), a stray capacitance (Cf) between the fourth extension portion (E4) and the tip end of the eleventh extension portion (E11), a stray capacitance (Cg) between the third extension portion (E3) and the eleventh extension portion (E11), and a stray capacitance (Ch) between the second extension portion (E2) and the eleventh extension portion (E11) can be generated.

For the first passive element (P1), the second passive element (P2), and the third passive element (P3), an inductor, a capacitor, or a resistor may be employed.

The ground pattern (GP) extends such that the tip end thereof is provided within a range from a position facing the connecting part (C) between the first element 3 and the second element 4 to a position facing the first passive element (P1). Specifically, as shown in FIG. 1, the ground pattern (GP) is formed such that the tip end of the ground pattern (GP) is positioned within a range from a position corresponding to the intersection with a virtual line K1 drawn perpendicularly to the extending direction of the ground pattern (GP) from the connecting part (C) between the first element 3 and the second element 4 to a position corresponding to the intersection with a virtual line K2 drawn perpendicularly to the extending direction of the ground pattern (GP) from the first passive element (P1).

Next, a description will be given of a resonance frequency in the antenna device of the present embodiment with reference to FIG. 4.

Figure 4:
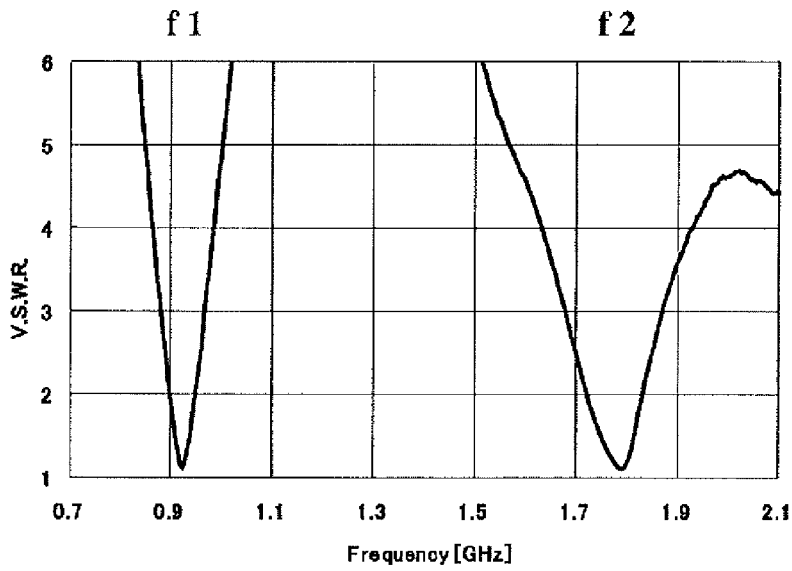
FIG. 4 is a graph illustrating VSWR properties (voltage standing wave ratio) of double resonance frequencies according to the present embodiment.

As shown in FIG. 4, the antenna device 1 of the present embodiment has multiple resonance frequencies at two frequencies, i.e., a first resonance frequency (f1) and a second resonance frequency (f2).

The first resonance frequency (f1) is in a low frequency band among two resonance frequencies, and is determined by each pattern (each extension portion) of the first element 3 and the second element 4, the first antenna element (AT1), the first passive element (P1), and the stray capacitance. Also, the second resonance frequency (f2) is determined by each pattern (each extension portion) of the first element 3 and the second element 4, the second passive element (P2), and the stray capacitance. For the resonance frequencies, the flow of high-frequency current to the ground pattern (GP) side is controlled by using the third passive element (P3) to thereby perform final impedance adjustment.

Hereinafter, a detailed description will be given of these resonance frequencies.

(First Resonance Frequency (f1))

The frequency of the first resonance frequency (f1) can be set and adjusted by the first antenna element (AT1.) and the length of each of the first extension portion (E1) to the seventh extension portion (E7).

Also, the widening of the first resonance frequency (f1) can be set by the length and width of each of the third extension portion (E3) to the sixth extension portion (E6).

The impedance of the first resonance frequency (f1) can be adjusted by setting stray capacitances that are the stray capacitance (Ca), the stray capacitance (Cb), the stray capacitance (Cd), and the stray capacitance (Ce).

Furthermore, final frequency adjustment can be flexibly made by selecting the first passive element (P1).

Final impedance adjustment can also be flexibly made by selecting the third passive element (P3).

As described above, the resonance frequency, and the bandwidth and the impedance thereof can be flexibly adjusted by use of "the lengths and widths of elements", "the passive elements", and "the stray capacitance between the first antenna element (AT1) and each element". Specifically, the first resonance frequency (f1) is mainly adjusted by a portion encircled by a broken line A1 in FIG. 1.

(Second Resonance Frequency (f2))

The frequency of the second resonance frequency (f2) can be set and adjusted by the length of each of the first extension portion (E1) to the fourth extension portion (E4), the seventh extension portion (E7), the tenth extension portion (E10), and the eleventh extension portion (E11).

Also, the widening of the second resonance frequency (f2) can be set by the length and width of each of the first extension portion (E1), the tenth extension portion (E10), and the eleventh extension portion (E11).

Also, the impedance of the second resonance frequency (f2) can be adjusted by setting stray capacitances that are the stray capacitance (Cd), the stray capacitance (Ce), the stray capacitance (Cf), the stray capacitance (Cg), and the stray capacitance (Ch).

Furthermore, final frequency adjustment can be flexibly made by selecting the second passive element (P2).

Final impedance adjustment can also be flexibly made by selecting the third passive element (P3).

As described above, the resonance frequency, the bandwidth, and the impedance thereof can be flexibly adjusted by use of "the lengths and widths of elements", "the passive elements", and "the stray capacitance between elements". Specifically, the second resonance frequency (f2) is mainly adjusted by a portion encircled by a dot-dash line A2 shown in FIG. 1.

It is desirable that the antenna size (in the present embodiment, substantially corresponds to the size of the substrate main body 2) be as large as possible in terms of antenna characteristics. It is preferable that the other configuration is set to the following conditions.

Specifically, it is desirable that the width of the antenna size (in the present embodiment, the distance between the ground pattern (GP) and the tip end of the tenth extension portion (E10), which is substantially equal to the narrow side length of the substrate main body 2) be as wide as possible in terms of the width of each element and the adjustment of stray capacitance.

It is also desirable that the length of the antenna size (in the present embodiment, the distance between the outer edge of the second extension portion (E2) and the outer edge of the fifth extension portion (E5), which is substantially equal to the long side length of the substrate main body 2) be as long as possible in terms of the length of each element and the adjustment of stray capacitance.

It is also desirable that the width of the sixth extension portion (E6) be as wide as possible. It is also desirable that the length of the fourth extension portion (E4) be as long as possible and the width of the fourth extension portion (E4) be as wide as possible. It is also desirable that the length of the eleventh extension portion (E11) be as long as possible. Furthermore, when a coaxial cable is connected to the feed point (FP), it is preferable that the coaxial cable has a length of equal to or greater than ¼ of the wavelength of a desired resonance frequency. When such a length cannot be ensured, it is preferable that the coaxial cable is connected to the feed point (FP) at the shortest distance.

As described above, in the antenna device 1 of the present embodiment, since the first element 3 extends with a gap provided between the first element and each of the second element 4, the third element 5, and the ground pattern (GP) such that a stray capacitance can be generated between the first element 3 and the second element 4, between the first element 3 and the third element 5, and between the first element 3 and the ground pattern (GP), the antenna device can be provided with a multiple resonance characteristic by effectively utilizing a stray capacitance between the first antenna element (AT1) serving as a loading element which is not self-resonant to a desired resonance frequency and each element.

By selecting the first antenna element (AT1), the first passive element (P1), and the second passive element (P2), an antenna device which is capable of flexibly adjusting resonance frequencies and achieving a double resonance characteristic depending on application, equipment, and design conditions can be obtained. Note that a bandwidth can be adjusted by setting the lengths and widths of the elements and the stray capacitances.

Design can be made within the plane of the substrate main body 2 so that thinning of the substrate main body 2 can be achieved as compared with the case where a conventional dielectric block, molded resin article, or the like is used. In addition, a size reduction and enhanced performance can be achieved by selecting the first antenna element (AT1) serving as a dielectric antenna. Furthermore, no additional cost is incurred due to change in die and design, resulting in realization of a low cost product.

Furthermore, a stray capacitance is generated between the ground pattern (GP) and the first element 3 and the ground pattern (GP) functions as a high-frequency current control unit that generates a high-frequency current flow in a direction along the ground pattern (GP). Consequently, even when a wide ground plane is not formed on the surface of the substrate main body 2, the influence of the routing of a coaxial cable or the like connected to the feed point (FP) on antenna characteristics can be reduced.

For example, in the absence of the ground pattern (GP) serving as a high-frequency current control unit, a high-frequency current supplied from an antenna device flows only in a direction opposite to the extending direction of the first extension portion (E1). Consequently, the antenna performance is greatly affected by the routing of a coaxial cable. Even when a cable other than a coaxial cable is employed as a power supply unit, a high-frequency current flows only in a direction opposite to the extending direction of the first extension portion (E1). Consequently, the antenna performance is greatly affected by the size or shape of a circuit-side substrate.

In contrast, in the presence of the ground pattern (GP) serving as a high-frequency current control unit, a high-frequency current flows in the extending direction of the second extension portion (E2), resulting in a reduction in the influence of the routing of a coaxial cable. In addition, the influence of a circuit-side substrate is reduced so that an antenna device can be provided with a multiple resonance characteristic even in the absence of a circuit-side substrate.

As described above, the size (corresponds to an antenna occupied area) of the substrate main body 2 can be reduced because a wide ground plane becomes unnecessary and the high degree of freedom in wiring and substrate installation can be obtained because the influence of the routing of a coaxial cable or the like connected to the feed point (FP) on antenna characteristics is reduced.

When the length of the ground pattern (GP) cannot be sufficiently ensured because of the small size of an antenna, a high-frequency current control function can be adjusted by adding a passive element such as a resistor, an inductor, a capacitor, or the like in series to the ground pattern (GP).

Since each of the first element 3 to the third element 5 includes the extension portions as described above, the stray capacitance (Ca) between the sixth extension portion (E6) and the first antenna element (AT1), the stray capacitance (Cb) between the sixth extension portion (E6) and the ground pattern (GP), the stray capacitance (Cd) between the eighth extension portion (E8) and the ground pattern (GP), the stray capacitance (Ce) between the eighth extension portion (E8) and the second extension portion (E2), the stray capacitance (Cf) between the fourth extension portion (E4) and the tip end of the eleventh extension portion (E11), the stray capacitance (Cg) between the third extension portion (E3) and the eleventh extension portion (E11), and the stray capacitance (Ch) between the second extension portion (E2) and the eleventh extension portion (E11) can be generated, resulting in obtaining a high degree of freedom in adjustment of resonance frequencies.

Also, since the first element 3 includes the wide portion (the fourth extension portion (E4)) which is formed facing the tip end of the third element 5 such that a stray capacitance can be generated therebetween, a stray capacitance between the tip end of the third element 5 and the wide portion can be readily set. In addition, the effective area of the entire antenna increases, resulting in achieving broadband and high gain features.

Thus, the antenna device 1 of the present embodiment can be provided with a double resonance characteristic by appropriately selecting the first antenna element (AT1), the first passive element (P1), and the second passive element (P2) so that communication can be established using two resonance frequencies corresponding to each application or each equipment.

EXAMPLES

Figure 5:
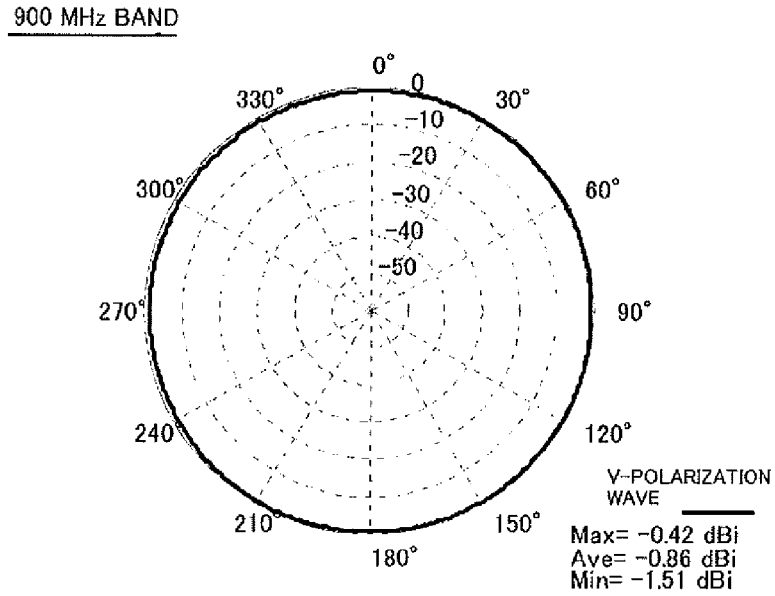
FIG. 5 is a graph illustrating the radiation pattern of an antenna device according an embodiment of the present invention.
Figure 5:
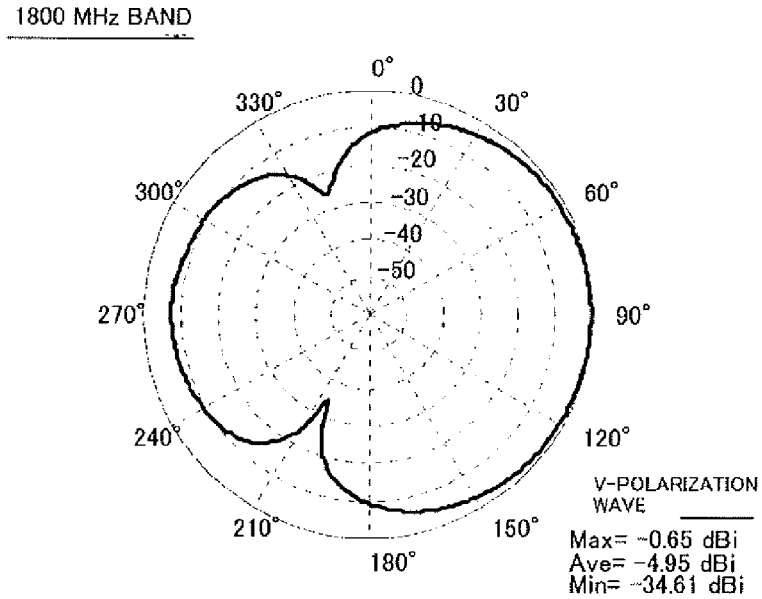

Next, a description will be given of the results of measurement of a radiation pattern at each resonance frequency using the practically manufactured antenna device of the present embodiment with reference to FIG. 5.

Note that the direction along which the first extension portion (E1) extends is defined as the X direction, the direction opposite to the direction along which the second extension portion (E2) extends is defined as the Y direction, and the vertical direction to the surface of the substrate main body 2 is defined as the Z direction. A vertical polarization wave to the Y-Z plane in this case was measured.

As the passive elements, the first passive element (P1): 12 nH, the second passive element (P2): 1.2 nH, the third passive element (P3): 18 nH were used where all the elements were inductors.

FIG. 5*a* shows a radiation pattern at the first resonance frequency (f1) of 900 MHz band, where the first resonance frequency (f1) was 923 MHz, the VSWR was 1.11, and the bandwidth (V.S.W.R≤3) was 89.2 MHz.

Also, FIG. 5*b* shows a radiation pattern at the second resonance frequency (f2) of 1800 MHz band, where the second resonance frequency (f2) was 1786 MHz, the VSWR was 1.10, and the bandwidth (V.S.W.R≤3) was 192.6 MHz.

As can be seen from these radiation patterns, antenna characteristics having almost no directivity were obtained for 900 MHz band, whereas antenna characteristics having directivity around 90-degree direction were obtained for 1800 MHz band.

The present invention is not limited to the aforementioned embodiment and various modifications may be made without departing the spirit of the present invention.

For example, when the antenna occupied area is small, the elements may be patterned not only on the surface of a substrate main body but also on the rear surface thereof or in the inner layer of a multilayer substrate.

Figure 6:
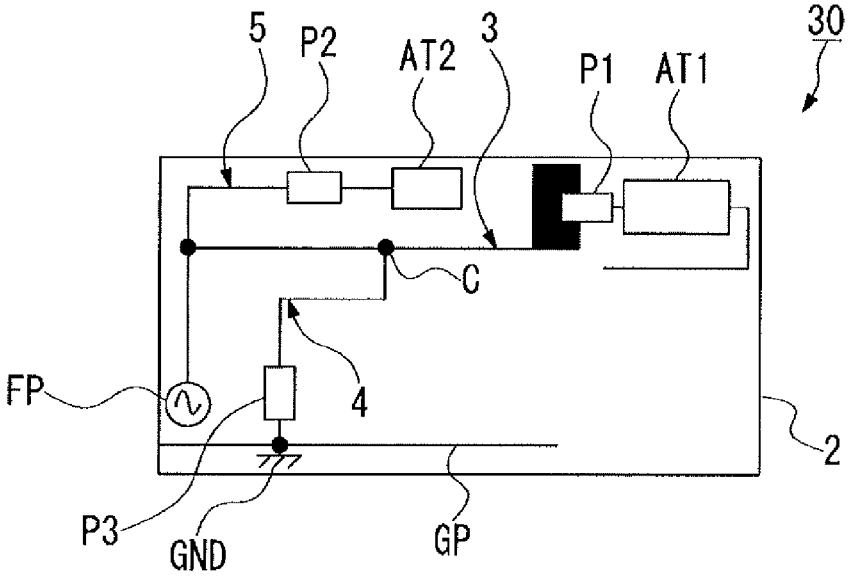
FIG. 6 is a wiring diagram illustrating an antenna device according to another example of the present embodiment.

As another example of the embodiment, as shown in FIG. 6, an antenna device 30 in which the eleventh extension portion (E11) of the second element 4 extends over a short length using the second antenna element (AT2) serving as the dielectric antenna may also be employed. Specifically, in the antenna device 30, the length of the tip end of the eleventh extension portion (E11) can be shortened by connecting the second antenna element (AT2) to the eleventh extension portion (E11) of the second element 4. Thus, the antenna device 30 is preferred in the case where the antenna occupied area is small. Also, in the antenna device 30, a greater stray capacitance (Cf) can be obtained by employing the second antenna element (AT2).

Thus, the antenna device 30 of another example of the embodiment is preferred for the design with focus on size reduction.

Note that an antenna device can further be reduced in size by using another antenna element instead of the first extension portion (E1) and the second extension portion (E2).

[Reference Numerals]

1, 30: antenna device, 2: substrate main body, 3: first element, 4: second element, 5: third element, AT1: first antenna element, AT2: second antenna element, E1: first extension portion, E2: second extension portion, E3: third extension portion, E4: fourth extension portion, E5: fifth extension portion, E6: sixth extension portion, E7: seventh extension portion, E8: eighth extension portion, E9: ninth extension portion, E10: tenth extension portion, E11: eleventh extension portion, GP: ground pattern, P1: first passive element, P2: second passive element, P3: third passive element, FP: feed point

What is claimed is:

1. An antenna device comprising:

an insulating substrate main body; and a ground pattern, a first element, a second element, and a third element each of which is patterned with metal foil on the substrate main body, wherein the ground pattern has a linear, uni-directional shape and extends in one direction while being connectable to a ground at the base end side, the first element extends such that a feed point is provided at the base end which is arranged near the base end side of the ground pattern, a first passive element is connected at an intermediate portion which is arranged along the ground pattern, and a first antenna element of a dielectric antenna is provided closer to the tip end side than the first passive element, the second element extends such that the base end thereof is connected to the base end side of the ground pattern and the tip end thereof is connected to the intermediate portion provided closer to the base end side than the first passive element of the first element, the third element extends such that the base end thereof is connected closer to the base end side than the first passive element of the first element and a second passive element is connected at an intermediate point, the first element extends with a gap provided between the first element and each of the second element, the third element, and the ground pattern so as to be able to generate a stray capacitance between the first element and the second element, a stray capacitance between the first element and the third element, and a stray capacitance between the first element and the ground pattern, and the ground pattern extends such that the tip end thereof is provided within a range from a position facing the connecting part between the first element and the second element to a position facing the first passive element.

2. The antenna device according to claim 1, wherein the first element comprises a first extension portion extending from the feed point provided on the ground pattern side in a direction away from the ground pattern, a second extension portion extending from the tip end of the first extension portion to the connecting part with the second element which extends in a direction along the ground pattern, a third extension portion extending from the tip end of the second extension portion to a direction along the ground pattern, a fourth extension portion extending from the tip end of the third extension portion in a direction away from the ground pattern, a fifth extension portion extending from the tip end of the first antenna element toward the ground pattern via the first passive element and the first antenna element which are juxtaposed in a direction along the ground pattern from the fourth extension portion, and a sixth extension portion extending from the tip end of the fifth extension portion toward the first extension portion along the ground pattern, the second element comprises a seventh extension portion extending in a direction away from the ground pattern, an eighth extension portion extending from the tip end of the seventh extension portion to a direction along the ground pattern, and a ninth extension portion extending from the tip end of the eighth extension portion to the connecting part with the first element in a direction away from the ground pattern, and the third element comprises a tenth extension portion extending from the first extension portion in the same direction as the first extension portion, and an eleventh extension portion extending from the tenth extension portion along the second extension portion.

3. The antenna device according to claim 1, wherein the first element comprises a wide portion which is formed facing the tip end of the third element so as to be able to generate a stray capacitance therebetween.

4. The antenna device according to claim 1, wherein a second antenna element of the dielectric antenna is provided at the tip end of the third element.

5. The antenna device according to claim 1, wherein the first element comprises a wide portion which is formed facing the tip end of the third element so as to be able to generate a stray capacitance therebetween, and a second antenna element of the dielectric antenna is provided at the tip end of the third element.

6. The antenna device according to claim 2, wherein the first element comprises a wide portion which is formed facing the tip end of the third element so as to be able to generate a stray capacitance therebetween.

7. The antenna device according to claim 2, wherein a second antenna element of the dielectric antenna is provided at the tip end of the third element.

8. The antenna device according to claim 2, wherein the first element comprises a wide portion which is formed facing the tip end of the third element so as to be able to generate a stray capacitance therebetween, and a second antenna element of the dielectric antenna is provided at the tip end of the third element.

* * * * *